US006116074A

United States Patent [19]

Thoms et al.

[11] Patent Number: 6,116,074

[45] Date of Patent: Sep. 12, 2000

[54] EXTRUSION ARRANGEMENT AND PROCESS FOR MANUFACTURING HOLLOW-PROFILE WORKPIECES MADE OF METAL

[75] Inventors: Volker Thoms, Calw; Andreas Poellmann, Herrenberf; Klaus Mueller, Berlin, all of Germany

[73] Assignee: Daimler-Benz Aktiengesellschaft, Germany

[21] Appl. No.: 09/064,757

[22] Filed: Apr. 23, 1998

[30] Foreign Application Priority Data

Apr. 23, 1997 [DE] Germany ..... 197 17 026

[51] Int. Cl.[7] ..... B21C 23/00

[52] U.S. Cl. ..... 72/256; 72/264; 72/268; 72/62; 72/370.22; 72/370.23

[58] Field of Search ..... 72/61, 62, 253.1, 72/254, 256, 257, 264, 268, 271, 370.01, 370.04, 370.06, 370.22, 370.23; 198/465.2; 29/421.1; 249/162; 164/323, 325; 425/340, 342.1, 387.1, 390, 395, 326.1; 264/211.12, DIG. 66, 564, 565

[56] References Cited

U.S. PATENT DOCUMENTS

| | | | |
|---|---|---|---|
| 4,787,598 | 11/1988 | Rahn et al. | 72/61 |
| 4,828,770 | 5/1989 | Fabian et al. | 264/40.3 |
| 4,860,565 | 8/1989 | Kato et al. | 72/253.1 |
| 5,372,774 | 12/1994 | Lupke | 264/508 |
| 5,531,585 | 7/1996 | Lupke | 425/233 |
| 5,593,703 | 1/1997 | Mizutani et al. | 425/71 |

FOREIGN PATENT DOCUMENTS

| | | | |
|---|---|---|---|
| 2456491A1 | 7/1976 | Germany . | |
| 4329812A1 | 3/1995 | Germany . | |
| 4425984A1 | 1/1996 | Germany . | |
| 663915A5 | 1/1988 | Switzerland . | |
| 1343601 | 1/1974 | United Kingdom | 72/260 |

*Primary Examiner*—Lowell A. Larson
*Assistant Examiner*—Ed Tolan
*Attorney, Agent, or Firm*—Evenson, McKeown, Edwards & Lenahan, P.L.L.C.

[57] ABSTRACT

An extrusion arrangement is disclosed for manufacturing hollow-profile workpieces made of metal, including an extrusion die which is guided in an extrusion chamber and compresses material situated in the extrusion chamber. For forming an extruded hollow profile, the extrusion die presses the material through a bottom die arranged on a head-side end of the extrusion chamber, a forming of the extruded hollow profile taking place by means of internal high pressure during the emerging from the bottom die. Advantageously, a plurality of forming tools are provided which can be alternately arranged adjoining the outlet opening of the bottom die for receiving an extruded hollow profile and its forming, and, for cooling and releasing the formed extruded profile, the tools can be removed from the bottom die.

20 Claims, 2 Drawing Sheets

EXTRUSION ARRANGEMENT AND PROCESS FOR MANUFACTURING HOLLOW-PROFILE WORKPIECES MADE OF METAL

BACKGROUND AND SUMMARY OF THE INVENTION

This application claims the priority of German application 197 17 026.9, filed in Germany on Apr. 23, 1998, the disclosure of which is expressly incorporated by reference herein.

The invention relates to an extrusion arrangement for manufacturing hollow-profile workpieces made of metal as well as to a process for manufacturing hollow-profile workpieces made of metal.

Preferred embodiments of the invention relate to extrusion arrangements of the type having an extrusion die which is guided in an extrusion chamber and compresses material situated in the extrusion chamber and, for forming an extruded hollow profile, presses the material through a bottom die arranged on the head-side end of the extrusion chamber, during the emerging from the bottom die into at least one forming tool adjoining an outlet opening of the bottom die, a forming of the extruded hollow profile taking place by means of internal high pressure.

Extruded hollow profiles produced by means of known extrusion arrangements and processes of this type are extruded as cut goods in the hot state and are stretched after their cooling. This stretching is necessary because, during the cooling, a hot-pressed profile is subjected to a warping and a shrinking of the material so that the outer dimensions of the extruded profile will change which has the result that the required measures are not met. For stretching the extruded profile, so-called collets are applied to sections provided for this purpose at the ends of the extruded profiles. After the stretching, these sections are removed for applying the collets and the profile is cut to the ordered measurements. After the cutting, the sections are available for being built in or for further processing. In the latter case the hollow extruded profile is brought into the desired shape, for example, by means of a known bending or forming process.

For this purpose, it is known from German Patent Document DE 44 25 984 A1 to place an extruded hollow profile in a mold corresponding to the component to be manufactured and then, by introducing a pressure medium in the hollow space of the extruded hollow profile, bulge or expand the extruded hollow profile until it is in contact with the mold surface, the supplied pressure medium being tempered so that the wall area of the extruded hollow profile to be deformed is brought in a controlled manner to a temperature above the ambient temperature in order to improve the deformability of the metallic material.

From German Patent Document DE 43 29 812 A1, it is known to insert a blank, which is made of an aluminum alloy and is cast in a billet shape, in a casting chamber in which the blank is inductively heated to a temperature which is higher than the hardening temperature but lower than the melting temperature of the aluminum alloy. This partially liquid, partially solid blank is then pressed by operating a casting plunger from the casting chamber into the hollow space of a mold, where the blank flows around a cooled arbor for forming a bore in the tube-shaped body to be manufactured.

From the processing of plastic materials, the so-called extrusion blow forming is known (compare *Extrusion Blow Forming*, VDI Publishers, Düsseldorf, 1979, Page 3, and on) in the case of which a hose-shaped preform is extruded and, by means of blowing air fed into the interior of the hose-shaped preform, is shaped to the finished part without any intermediate thermal treatment in the thermoplastic condition.

Based on the above, it is an object of the invention to provide an extrusion arrangement and a process for manufacturing hollow-profile workpieces by means of which, for manufacturing hollow-profile workpieces from metal, a continuous extrusion process is permitted with a piece manufacturing at the outlet of the billet without the requirement of an intermediate treatment of the extruded hollow profile, such as stretching, cooling, heating and the like.

For achieving this object, an extrusion arrangement is proposed according to the invention wherein a plurality of forming tools are provided for receiving an extruded hollow profile and forming same, said plurality of forming tools being alternately arranged adjoining the outlet opening of the bottom die and, for cooling and releasing the formed extruded hollow profile, being removable from the bottom die.

In the case of the extrusion arrangements according to the invention, the emerging from the bottom die is followed immediately by a forming of the extruded hollow profile by internal high pressure so that, while utilizing the process heat and without additional heating, a postforming of the extruded hollow profile is permitted. Especially in the case of aluminum materials, the forming can be carried out by means of hot forming at low differential pressures which, however, must be applied for a relatively long time period. According to the invention, a higher pressure admission takes place for a short time in that a suitable fluidic medium (gaseous or liquid) is fed into the interior of the extruded hollow profile particularly from the machine side during the extrusion.

As a further development of the invention, an arbor is provided with a bore which can be acted upon by a pressure medium and which is connected with the interior of the extruded hollow profile. As a result, a particularly simple feeding of the pressure medium into the interior of the extruded hollow profile is permitted.

In a further development of the invention, the bottom die is a hollow-chamber bottom die which has a connection which can be acted upon by a pressure medium and is connected with the interior of the extruded hollow profile, which also permits a particularly simple feeding of the pressure medium into the interior of the extruded hollow profile.

In a further development of the invention, a forming tool is provided which adjoins an outlet opening of the bottom die, whereby a precise forming of the extruded hollow profile is ensured. This forming tool advantageously has an at least two-part construction in order to facilitate a release of the formed extruded hollow profile.

In a particularly advantageous further development of the invention, a plurality of forming tools are provided which alternately can be arranged for receiving an extruded hollow profile and its forming adjoining the outlet opening of the bottom die and can be removed for the cooling and releasing of the formed extruded hollow profile from the bottom die. This further development of the extrusion arrangement according to the invention prevents that the release and the cutting-off of the formed extruded hollow profile impairs the extruding rate of the extrusion arrangement. In that several forming tools are alternately arranged to be adjoining the outlet opening of the bottom die, a continuous extruding process is possible with an integrated hot forming of the extruded hollow profile.

As a further development of the invention, the forming tools are arranged in the manner of a rotational change system in the extruding direction behind the bottom die, or they are arranged as a linear adjusting and displacing system in the extruding direction behind the bottom die.

Also for achieving the object on which the invention is based, a process is suggested for manufacturing hollow-profile workpieces made of metal having the characteristics according to which the interior of the extruded hollow profile for the forming from the process heat is acted upon by a pressure medium.

In especially advantageous preferred embodiments of the invention, the forming of the extruded hollow profile takes place in a forming tool.

Other objects, advantages and novel features of the present invention will become apparent from the following detailed description of the invention when considered in conjunction with the accompanying drawings.

DETAILED DESCRIPTION OF THE DRAWINGS

Figure 1:
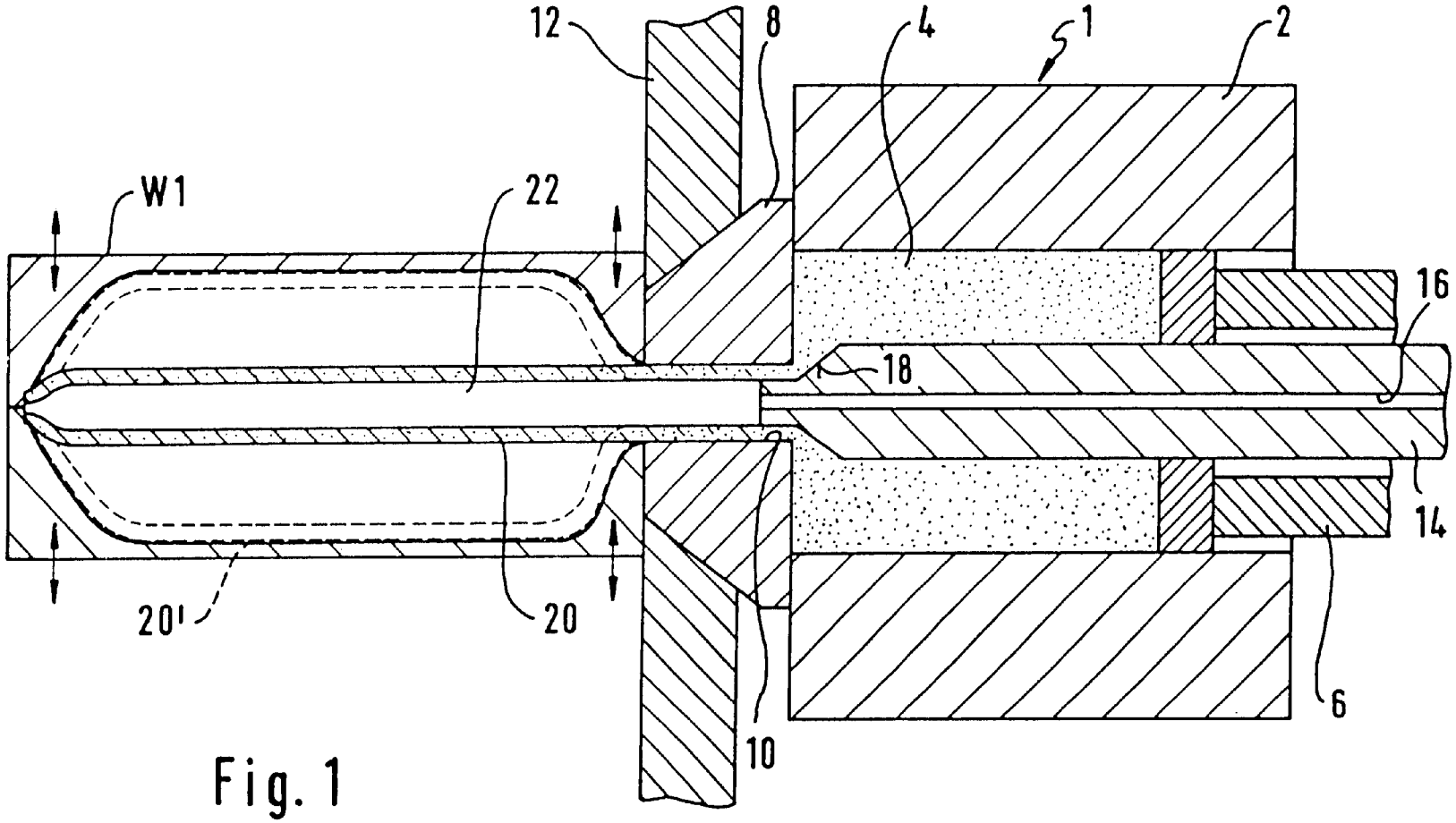
FIG. 1 is a lateral longitudinal sectional view of an extrusion arrangement according to a preferred embodiment of the invention with a forming tool adjoining the outlet opening of the bottom die.

FIG. 1 is a longitudinal sectional view of the extrusion arrangement 1 according to the invention for manufacturing hollow-profile workpieces made of metal, having an extrusion chamber 2, which comprises a hollow space for receiving metal material 4, and having an extrusion die 6 which is guided in the extrusion chamber 2 and compresses the metal material 4 by means of a longitudinal movement (in the representation of FIG. 1, to the left).

On the head-side end of the extrusion chamber 2 situated in the extruding direction of the extrusion die 6, a bottom die 8 is arranged which closes off the hollow space of the extrusion chamber 2 and has an outlet opening 10 in a stationary crosshead 12. In the hollow space of the extrusion chamber 2, an arbor 14 is provided which is arranged essentially concentrically with respect to the outlet opening 10 of the bottom die 8 and which, on its end situated in the extruding direction, has a conical tapering 18 which extends into the outlet opening 10 of the bottom die 8. Furthermore, the arbor 14 has a continuous bore 16 which extends in the longitudinal direction of the arbor 14 and has a mouth on the conically tapering end.

For manufacturing an extruded profile, the metal material situated in the extrusion chamber 2 is compressed by the extrusion die 6 and is pressed around the arbor 14 through the outlet opening 10 of the bottom die, whereby an extruded hollow profile 20 is created whose cross-section depends on the shape of the outlet opening 10.

According to the invention, immediately following the extrusion operation, a pressure medium (not shown) is fed through the bore 16 of the arbor 14 into the interior 22 of the extruded hollow profile 20, whereby an expansive forming of the extruded hollow profile 20 takes place. This may be a free expansion or an expansion which is limited by a forming tool, as illustrated in the example of FIG. 1.

According to the invention, a forming tool W1 is provided in the embodiment illustrated in FIG. 1 which, by means of an opening, adjoins the outlet opening 10 of the bottom die 8 so that the extruded hollow profile 20 emerging from the opening 10 is introduced into the interior of the forming tool W1. During the subsequent admission of pressure through the bore 16 of the arbor 14, an expansion of the extruded hollow profile 20 takes place up to a contact with the hollow mold defined by the interior of the forming tool W1 so that the extruded profile 20 assumes the final shape 20' illustrated by a broken line in the drawing.

The forming tool W1 is advantageously constructed in several parts, particularly in two parts, so that the formed hollow-profile workpiece is released by means of the simple lifting off of the forming tool parts in the direction of the indicated double arrows.

According to the invention an extruded hollow profile 20 is therefore postformed out of the process heat in the billet by hot forming. As a result, it is achieved that the extruded hollow profile which, in the cold condition, can be formed only by means of special materials, is formed without any additional heating, thus only by means of the process heat of the extrusion operation. For building up the internal high pressure in the interior of the extruded hollow profile, any suitable, for example, gaseous or liquid pressure medium can be used which is fed by way of a bridge tool or, as illustrated in the embodiment of FIG. 1, through a bore of the arbor on the machine side during the extrusion.

Only after the hot-forming according to the invention, the billet will be cut off from the extruded hollow profile mechanically, thermally or fluidically. Since this cutting operation must not influence the extruding rate, a plurality of forming tools W1, W2, W3 are provided according to the invention (compare FIG. 2) which, alternately for receiving an extruded hollow profile and its hot-forming can be arranged adjoining the outlet opening 10 of the bottom die 8, and, for the cooling and releasing of the formed extruded hollow profile, can be removed from the bottom die.

Figure 2:
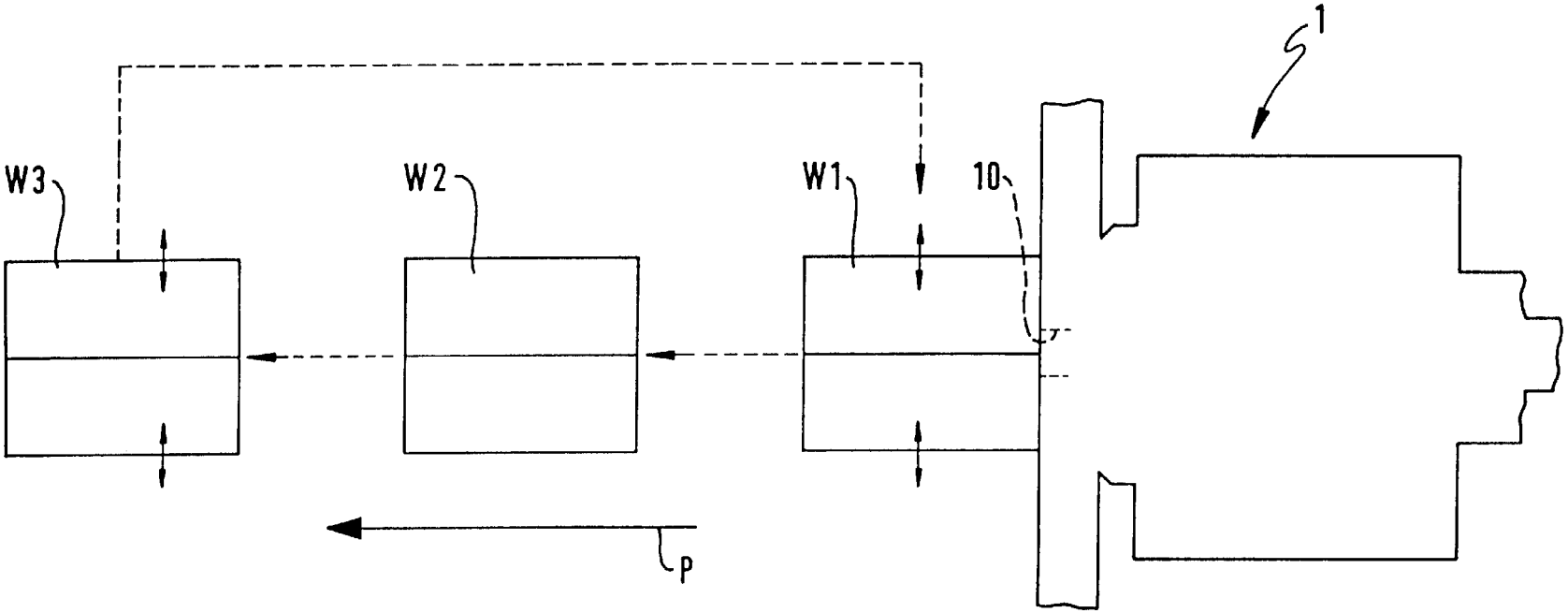
FIG. 2 is a reduced schematic representation of the extrusion arrangement of FIG. 1 with a plurality of forming tools arranged in the extruding direction behind the bottom die in accordance with preferred embodiments of the present invention.

In the embodiment of FIG. 2, three forming tools W1, W2, W3 are provided and are arranged, as a linear adjusting and displacing system, in the extruding direction behind the outlet opening 10 of the bottom die 8. The forming tools W1, W2, W3 are displaceably arranged along a cooling path illustrated by the arrows P in the direction of the arrows indicated by a broken line, in which case the respective last forming tool of the row (in the representation of FIG. 2, forming tool W3) can be displaced back from the linear arrangement into the starting position adjoining the outlet opening 10 of the bottom die 8 in order to replace the first forming tool of the row there (in the representation of FIG. 2, forming tool W1) which, along the cooling path P, moves away from the extrusion arrangement 1. This displacing back into the starting position adjoining the outlet opening 10 can take place such that the forming tool W3 is displaced back as a whole in the direction of the arrow indicated by a broken line. However, in the case of a multi-part, particularly two-part construction of the forming tools, it is also possible to move apart in the direction of the indicated double arrows the individual parts of the forming tool (W3), which is last in the row arrangement, for releasing the formed extruded hollow profile and to displace them separately from one another back onto the stationary crosshead 12 of the extrusion arrangement 1 in order to join them again there for receiving and deforming another billet.

In another further development of the invention, which is not shown, the forming tools are arranged in the manner of a rotational change system in the extruding direction behind the bottom die 8 and, like a revolver drum, are moved successively into a position adjoining the outlet opening 10 of the bottom die 8.

According to the invention, an extrusion arrangement is therefore provided by means of which a continuous extruding and hot-forming of extruded hollow profiles is permitted with the result of a piece manufacturing at the outlet of the billet.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Extrusion arrangement for manufacturing hollow-profile workpieces made of metal, having an extrusion die which is guided in an extrusion chamber and compresses material situated in the extrusion chamber and, for forming an extruded hollow profile, presses the material through a bottom die arranged on a head-side end of the extrusion chamber, during emerging from the bottom die into at least one forming tool adjoining an outlet opening of the bottom die, a forming of the extruded hollow profile taking place by means of internal high pressure, wherein a plurality of forming tools are provided for receiving an extruded hollow profile and forming same, said plurality of forming tools being alternately arranged adjoining the outlet opening of the bottom die and, for cooling and releasing the formed extruded hollow profile, are removable from the bottom die.

2. Extrusion arrangement according to claim 1, wherein the forming tools are arranged in the manner of a rotational change system in the extruding direction behind the bottom die.

3. Extrusion arrangement according to claim 1, wherein the forming tools are arranged as a linear adjusting and displacing system in the extruding direction behind the bottom die.

4. Extrusion arrangement according to claim 1, wherein at least one of the forming tools is constructed at least in two parts.

5. Extrusion arrangement according to claim 1, wherein for forming an extruded hollow profile, an arbor is provided in the extrusion chamber which has a bore adapted to be acted upon by a pressure medium and which is connected with the interior of the extruded hollow profile.

6. Extrusion arrangement according to claim 1, wherein the bottom die is a hollow-chamber bottom die having a bore adapted to be acted upon by a pressure medium and is connected with the interior of the extruded hollow profile.

7. Extrusion arrangement according to claim 1, wherein each of the forming tools are constructed at least in two parts which are movable away from one another to be separated from formed workpieces.

8. Extrusion arrangement according to claim 7, wherein three of said forming tools are provided which are movably disposed and selectively positionable at the hollow profile to facilitate continuous extrusion while forming the workpieces.

9. Assembly for making hollow profile metal workpieces comprising:

an extrusion chamber which in use houses metal material, a bottom die disposed at one side of the extrusion chamber, and extrusion press member which in use presses the metal material in the extrusion chamber through the bottom die to form an extruded hollow profile, and a plurality of internally pressurized moveable forming tools selectively engageable with and movable with the extruded hollow profile and operable to form the hollow profile into respective individual workpieces with continuous extruding of the metal material.

10. Assembly according to claim 9, wherein the forming tools are arranged in the manner of a rotational change system in the extruding direction behind the bottom die.

11. Assembly according to claim 9, wherein the forming tools are arranged as a linear adjusting and displacing system in the extruding direction behind the bottom die.

12. Assembly according to claim 9, wherein for forming an extruded hollow profile, an arbor is provided in the extrusion chamber which has a bore adapted to be acted upon by a pressure medium and which is connected with the interior of the extruded hollow profile.

13. Assembly according to claim 9, wherein the bottom die is a hollow-chamber bottom die having a bore adapted to be acted upon by a pressure medium and is connected with the interior of the extruded hollow profile.

14. A method of making hollow profile metal workpieces comprising:

extruding continuous hollow metal profile, and forming the hollow metal profile utilizing forming tools which are selectively engageable with and movable along the travel path of the hollow metal profile, internal fluid pressure being applied into said hollow metal profile to force the same against the forming tools, whereby the heat added to the hollow metal profile during extruding facilitates the forming without requiring additional heating of the hollow metal profile.

15. A method according to claim 14, wherein each of the forming tools are constructed at least in two parts which are movable away from one another to be separated from formed workpieces.

16. A method according to claim 15, wherein three of said forming tools are provided which are movably disposed and selectively positionable at the hollow profile to facilitate continuous extrusion while forming the workpieces.

17. A method according to claim 14, wherein the forming tools are arranged in the manner of a rotational change system in the extruding direction behind the bottom die.

18. A method according to claim 14, wherein the forming tools are arranged as a linear adjusting and displacing system in the extruding direction behind the bottom die.

19. A method according to claim 14, wherein for forming an extruded hollow profile, an arbor is provided in the extrusion chamber which has a bore adapted to be acted upon by a pressure medium and which is connected with the interior of the extruded hollow profile.

20. A method according to claim 14, wherein the bottom die is a hollow-chamber bottom die having a bore adapted to be acted upon by a pressure medium and is connected with the interior of the extruded hollow profile.

* * * * *